US006905328B2

(12) United States Patent
Poe

(10) Patent No.: US 6,905,328 B2
(45) Date of Patent: Jun. 14, 2005

(54) LOW $NO_X$ RADIANT WALL BURNER

(75) Inventor: Roger L. Poe, Beggs, OK (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 10/624,708

(22) Filed: Jul. 22, 2003

(65) Prior Publication Data

US 2004/0053180 A1 Mar. 18, 2004

Related U.S. Application Data

(62) Division of application No. 09/803,808, filed on Mar. 12, 2001, now Pat. No. 6,607,376.

(60) Provisional application No. 60/188,807, filed on Mar. 13, 2000, and provisional application No. 60/208,404, filed on May 31, 2000.

(51) Int. Cl.[7] ..... F23C 5/28

(52) U.S. Cl. ..... 431/175; 431/177; 431/187; 431/284; 431/348; 431/354; 431/8

(58) Field of Search ..... 431/175, 177, 431/187, 284, 348, 354, 8, 217; 239/552, 553

(56) References Cited

U.S. PATENT DOCUMENTS

| | | | | |
|---|---|---|---|---|
| 2,762,428 | A | | 9/1956 | Blaha |
| 3,182,712 | A | | 5/1965 | Zink et al. |
| 3,639,095 | A | | 2/1972 | Zink et al. |
| 3,684,424 | A | | 8/1972 | Zink et al. |
| 4,257,762 | A | | 3/1981 | Zink et al. |
| 4,402,666 | A | | 9/1983 | Glomm et al. |
| 4,702,691 | A | | 10/1987 | Ogden |
| 5,131,838 | A | | 7/1992 | Gensler et al. |
| 5,271,729 | A | | 12/1993 | Gensler et al. |
| 5,338,186 | A | | 8/1994 | Sulzhik et al. |
| 5,813,846 | A | * | 9/1998 | Newby et al. ..... 431/9 |
| 6,019,595 | A | * | 2/2000 | Wulfert et al. ..... 431/181 |

FOREIGN PATENT DOCUMENTS

| | | |
|---|---|---|
| DE | 941 679 | 4/1956 |
| JP | 4-126906 | 4/1992 |
| TW | 353508 | 4/1998 |

OTHER PUBLICATIONS

Design Principles of Gas Burner Equipment, Reprinted Oct. of 1996, Lai Keng Yang (Author), Fu Han Publishers Ltd., p. 58, Section (8).

* cited by examiner

*Primary Examiner*—Stephen Gravini
(74) *Attorney, Agent, or Firm*—James H. Marsh, Jr.; Stinson Morrison Hecker LLP

(57) ABSTRACT

A low $NO_x$ burner nozzle assembly for a radiant wall burner includes an elongated hollow burner tube and a discharge nozzle. The burner tube defines a conduit for supplying a mixture of fuel and air to a radiant combustion area of a combustion zone that surrounds the nozzle assembly. The discharge nozzle is mounted on the tube at the downstream end of the conduit adjacent the radiant combustion area and the same is adapted for directing the mixture of fuel and air into the radiant combustion area in an essentially radial direction. The discharge nozzle includes a plurality of flow directing members arranged in an array which extends circumferentially around the discharge nozzle, and the same are arranged to define therebetween a plurality of passageways which extend in a generally radial direction. The passageways are arranged so as to have different respective flow areas. The discharge nozzle also has an end cap to prevent axial flow of the primary air/fuel mixture. The end cap has an axially extending hole therein, and the nozzle assembly includes a staged fuel burner nozzle arranged so as to protrude axially through such hole and deliver staged fuel to the combustion zone in spaced relationship to the radiant combustion area.

26 Claims, 8 Drawing Sheets

LOW $NO_X$ RADIANT WALL BURNER

REFERENCE TO RELATED APPLICATION

This application is a divisional of and claims priority pursuant to 35 U.S.C. § 120 from application Ser. No. 09/803,808, filed Mar. 12, 2001 now U.S. Pat. No. 6,607,376, which application Ser. No. 09/803,808 in turn claim priority pursuant to 35 U.S.C. § 119(e) from provisional application Ser. No. 60/188,807, filed Mar. 13, 2000 and Ser. No. 60/208,404, filed May 31, 2000. The entireties of the disclosures of said prior application Ser. Nos. 09/803,808, 60/188,807 and 60/208,404 are hereby specifically incorporated herein by this specific reference thereto.

BACKGROUND OF THE INVENTION

1. Field of the Invention

The present invention relates to the field of radiant wall burners. In particular the invention relates to radiant wall burners wherein a number of technologies are combined in a single burner arrangement so as to achieve low $NO_x$ and low noise.

2. The State of the Prior Art

Reduction and/or abatement of $NO_x$ in radiant burners has always been a desirable aim. Some $NO_x$ abatement has been achieved in the past by staging a portion of the gaseous fuel. Low pressure staged gas may be introduced into the combustion zone either from low pressure gas tips arranged around the periphery of the burner or from a center gas tip which protrudes through the center of the end cap of the radiant burner nozzle. These arrangements have not always been successful because, for $NO_x$ abatement purposes, the staged fuel should not be introduced into areas of the combustion zone where the oxygen concentration is greater than about 4% by volume.

SUMMARY OF THE INVENTION

Various problems encountered in prior art burners are addressed by the concepts and principles of the present invention. In particular, the invention addresses the ever present need for $NO_x$ abatement. In accordance with one aspect of the invention, it has been found that when gas is burned in a staged manner it may sometimes be responsible only for about 6 ppm (vol) of the total $NO_x$ emissions of an individual burner. Accordingly it has been thought to be desirable to adapt the concept of fuel staging to radiant wall burners. Several different configurations have been tried, some more successful than others, but none with complete satisfaction. In some configurations, staged fuel has been delivered through a plurality of tubes at very low pressure around the circumference of the burner. In such a case the staged fuel is introduced in proximity to a combusting mixture which is still quite rich in oxygen. This excess oxygen leads to higher flame temperatures and higher $NO_x$ content in flue gases.

In other configurations, staged gas has been introduced into the combustion zone from the axially distal end of the premix discharge nozzle. This configuration, where the staged fuel is injected coaxially at the center line of the premix burner assembly, has been somewhat more successful in achieving lower $NO_x$ emissions than the first configuration discussed above, at least in part due to the fact that the introduction point is located in spaced relationship to the face of the tile as well as away from the oxygen rich stream leaving the premix discharge nozzle. The down side of this particular methodology is that the momentum of the staged gas jet can and often does pull the primary oxygen rich premixed stream into the jet as an entrained flow thereby increasing the availability of excess oxygen as well as the production of $NO_x$. This problem is exacerbated in applications requiring a multiplicity of individual burners in an array because of the interactions between burners.

In accordance with an important aspect of the invention, a low $NO_x$ burner nozzle assembly is provided for a radiant wall burner. The assembly includes an elongated hollow burner tube and a discharge nozzle. The burner tube has a central, longitudinally extending axis and defines a conduit extending along the axis for supplying a mixture of fuel and air to a radiant combustion area of a combustion zone that extends radially and surrounds the nozzle assembly. This mixture may desirably be fuel lean. The discharge nozzle is mounted on the tube at a downstream end of the conduit adjacent the combustion zone, and the same is adapted for receiving the mixture of fuel and air from the conduit and directing the same into the radiant combustion area in an essentially radial direction relative to the axis of the tube. The discharge nozzle may include a plurality of flow directing members arranged in an array which extends circumferentially around the discharge nozzle and the members may desirably be arranged to define therebetween a plurality of passageways which extend in a generally radial direction relative to the axis. The discharge nozzle may also include an end cap that is mounted on the members in a position to close the conduit and prevent flow of the mixture in a direction along the axis. Thus, the mixture is caused to flow through the passageways in a generally radial direction.

Preferably, the flow directing members may be arranged so that some of the passageways therebetween have a larger flow area than others. Desirably, the members may be in the form of plates which are essentially rectangular in shape. Ideally, the passageways may also extend in an axial direction. In a much preferred form of the invention, the end cap may have a lateral edge which is located at a first radial distance from the axis, and the members may each have an outer edge located at a second radial distance from the axis. The second radial distance ideally may be greater than the first radial distance such that passageways defined by the members extend radially outward beyond the lateral edge of the end cap.

In accordance with another preferred form of the invention, the nozzle may include an internal baffle positioned and arranged to redirect at least a portion of the mixture flowing through the conduit and cause the same to flow through the passageways in a generally radial direction.

In yet another preferred form of the invention, the end cap may have an axially extending hole therein, and the nozzle assembly may include a centrally located staged fuel burner nozzle made up, for example, of a length of tubing which extends along the axis of the conduit. The assembly may also include a staged burner nozzle tip at a downstream end of the length of tubing. In accordance with this aspect of the invention, the staged fuel burner nozzle may desirably be arranged so as to protrude axially through the hole. Importantly, the tip ideally may have a fuel delivery orifice therein for delivering fuel to the combustion zone in spaced relationship to the radiant combustion area.

In one desirable form of the invention, the delivery orifice may be disposed so as to introduce fuel gas into zone 20 at an upward and outward angle relative to a plane that is perpendicular to the axis. Preferably, the angle may be at least about 30°, and for some purposes in accordance with the invention, the delivery orifice may be disposed to introduce fuel gas in a direction along the axis.

Even more desirably, the staged fuel burner nozzle may be positioned such that a downstream portion of the length of tubing protrudes beyond the end cap so that the tip is positioned in axially spaced relationship relative to the end cap. Ideally, in this particularly desirable form of the invention, the low $NO_x$ burner nozzle may include an elongated protective sheath disposed in surrounding relationship to the protruding portion of the length of tubing and the tip. Such sheath may desirably include an opening disposed in alignment with the orifice. The sheath may also be provided with one or more vent openings configured to permit gases between the sheath and the length of tubing to escape into the combustion zone. In accordance with the foregoing aspects of the invention, the staged burner nozzle may be of significant value, regardless of the form of the discharge nozzle. Thus, the staged burner tip of the invention may be used with any sort of radial discharge nozzle that operates to spread a combustible mixture of fuel and air radially across the face of a radiant tile.

In accordance with yet another aspect of the invention, the burner tube may comprise a venturi tube having a throat that is in communication with an air supply and a source of fuel gas under pressure. The venturi tube may desirably be arranged such that the flow of fuel gas through the throat induces a flow of air from the air source whereby the mixture of fuel and air is created in the throat and caused to flow toward the discharge nozzle.

The invention also provides a low $NO_x$ radiant wall burner comprising a burner tile having a central opening surrounded by a radiant tile face and an elongated low $NO_x$ burner nozzle assembly as described above that extends through such opening. The face of the burner tile may be either dished or flat.

In addition, the invention provides a method for operating a burner comprising providing a mixture of fuel and air at a centrally located point adjacent a face of a burner tile, separating the mixture into a plurality of separate streams and causing such streams to flow radially outwardly from the centrally located point across the face of the tile, and causing the velocity of some of the streams to be greater than the velocity of others of the streams.

The invention further provides a method for operating a burner which includes the steps of providing a mixture of fuel and air at a centrally located point adjacent a face of a burner tile, separating the mixture into a plurality of separate streams and causing the streams to flow radially outwardly from the point across the face of the tile, causing the streams to combust to form flames, each having an outer peripheral terminus spaced radially from the point, and providing secondary air to the flame at a location adjacent the termini.

In yet another form, the invention provides a method for operating a burner that comprises providing a mixture of fuel and air, causing the mixture to flow along a path to a centrally located point adjacent a face of a burner tile, separating the mixture into a plurality of separate streams and causing the streams to flow radially outwardly from the path across the face of the tile, causing the streams to combust to form flames in an area of a combustion zone adjacent the face, and providing staged fuel to the zone at a location spaced from the area. In accordance with this form of the invention, the oxygen content of the gases at the location where the staged fuel is introduced is desirably not more than about 4% by volume.

The invention also provides a low $NO_x$ burner assembly which includes an elongated hollow burner tube providing a longitudinally extending conduit for supplying a mixture of fuel and air to a combustion zone. The burner tube has an outer wall surrounding the conduit, a longitudinally extending central axis and a pair of spaced ends. The assembly also includes a discharge nozzle at one of the ends of the burner tube, an inlet for a mixture of fuel and air at the other end of the burner tube, and at least one port extending through the wall at a location between the discharge nozzle and the inlet to communicate the conduit with an external area located outside the burner tube. Desirably the port may have a center axis which is essentially perpendicular to the central axis of the tube. Alternatively, the port may have a center axis which is at an angle relative to the central axis of the tube. Ideally the assembly may include a plurality of ports extending through the wall of the tube at respective locations between the discharge nozzle and the inlet. In one preferred form of the invention, the ports may be arranged in one or more rows which extend around the outer wall of the tube.

In another form of the invention, the ports described above may be utilized in combination with a discharge nozzle that includes a plurality of flow directing members as described, which are arranged to define therebetween a plurality of passageways which extend in generally radial directions relative to said axis, and an end cap mounted on said members in a location to redirect at least a portion of the mixture flowing from the end of the conduit and cause the same to flow through said passageways in a generally radial direction. In accordance with the invention, the members may be arranged so that some of the passageways have a larger flow area than others of the passageways.

The nozzle assembly having at least one port extending through the wall of the burner tube may be used as a component of a low $NO_x$ radiant wall burner that includes a burner tile having a central opening. In such a case, the nozzle assembly may extend through the central opening of the tile. Desirably, the discharge nozzle may include a plurality of flow directing members which are arranged to define therebetween a plurality of passageways which extend in generally radial directions relative to the axis of the burner tube, and an end cap mounted on said members in a location to redirect at least a portion of the mixture flowing from the end of the conduit and cause the same to flow through said passageways in a generally radial direction so that when ignited, the redirected mixture of fuel and air provides a generally laterally extending flame having an outer peripheral extremity at a location in said zone spaced radially from said axis.

The invention further provides a method for operating a burner which includes the steps of causing a mixture of fuel and air to flow toward a centrally located point adjacent a face of a burner tile, causing additional air to flow toward a location adjacent said face which is spaced laterally from said point, and separating a portion of said mixture and intermixing the same with said additional air to create an ultra lean admixture capable of flameless oxidation before the additional air reaches said location. More particularly, the method may include the steps of causing a mixture of fuel and air to flow toward a centrally located point adjacent a face of a burner tile, separating a first portion of said mixture into a plurality of separate streams and causing said streams to flow radially outwardly from said point across the face of said tile, causing said streams to combust to form flames, each having an outer peripheral terminus spaced radially from said point, providing secondary air to said flame at a location adjacent said termini, adding a second portion of said mixture to said secondary air at a location upstream from said location to create an admixture capable of flameless oxidation at the face of said tile, and Blamelessly oxidizing said admixture at said face to create relatively cool oxidation products. In accordance with the concepts and principles of the invention, oxidation products may be admixed with the combusting gases to thereby dilute and cool the same. In further accordance with the principles and concepts of the invention, a flow of recirculated flue gas may be provided to said flame at a location adjacent said termini.

Prior art burners of the premix type of design have not been able to utilize as many $NO_x$ abatement technologies in a single burner as are provided in the burner arrangements of the present invention.

DETAILED DESCRIPTION OF PREFERRED EMBODIMENTS OF THE INVENTION

Figure 1:
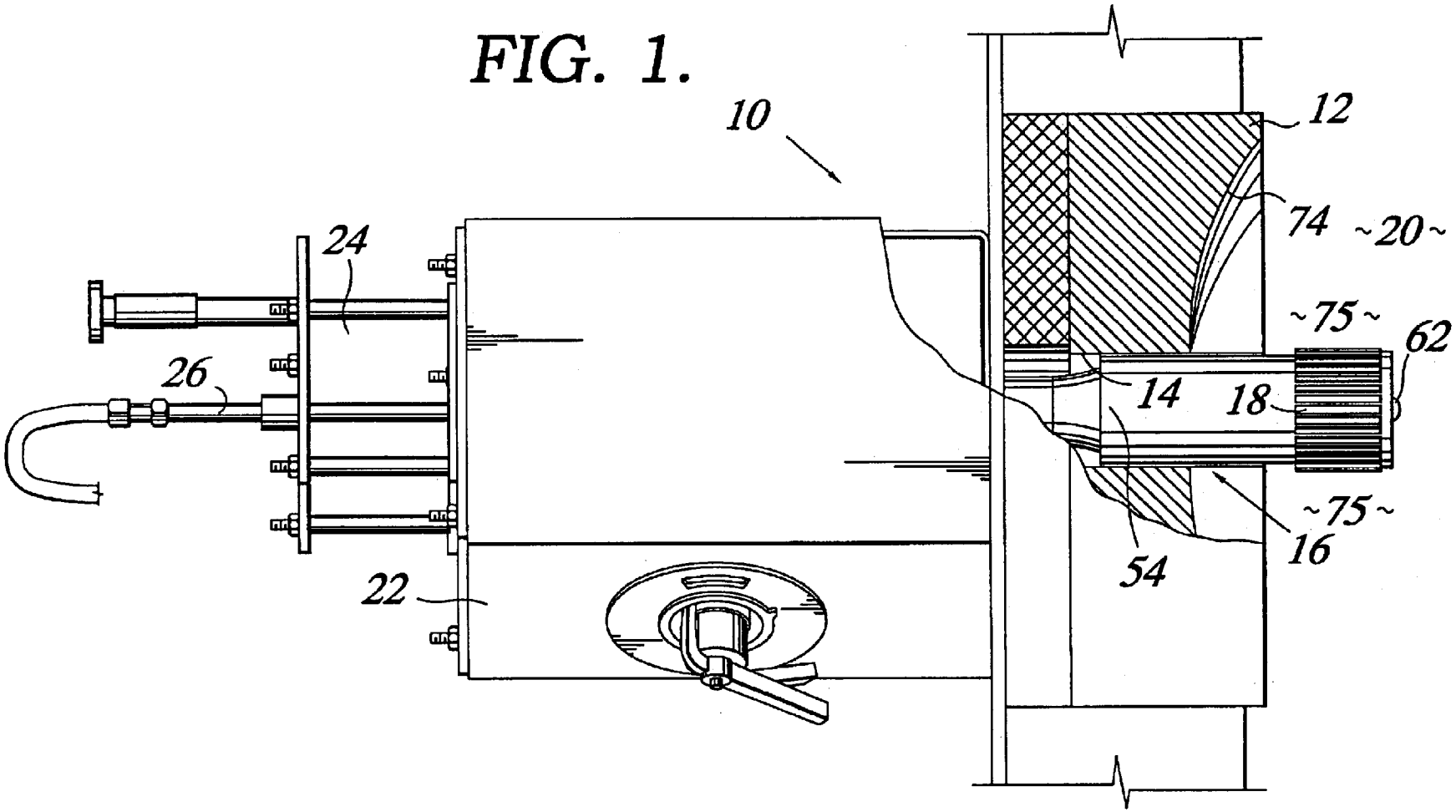
FIG. 1 is a side elevational view, partly in cross-section, of a low $NO_x$ radiant wall burner which embodies the concepts and principles of the invention.

A burner 10 which embodies the concepts and principles of the invention is illustrated in FIG. 1 where it can be seen that the same includes a burner tile 12 having a centrally disposed opening 14 and a burner nozzle assembly 16 including a burner discharge nozzle 18 which protrudes through opening 14 and extends into a combustion zone 20. The burner 10 may also include conventional components such as a muffler 22, an air door 24 and an inlet tube 26 facilitating connection to a source of fuel gas.

Figure 2:
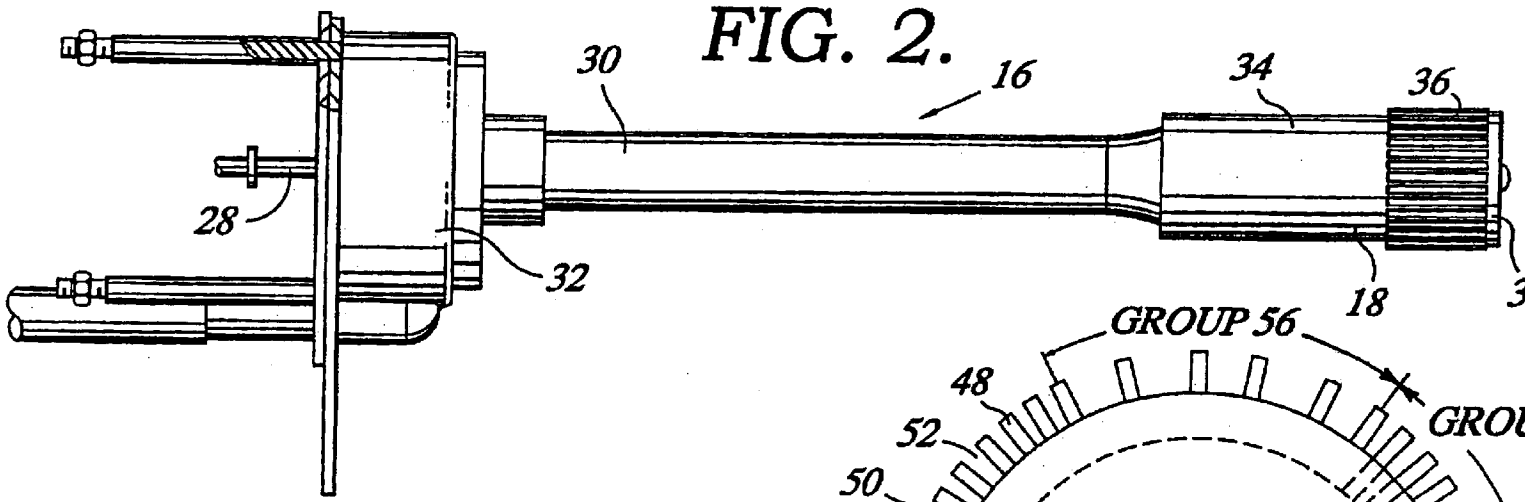
FIG. 2 is a side elevational view of the nozzle arrangement of the burner of FIG. 1.

With reference to FIG. 2, it can be seen that the nozzle assembly 16 may include spud 28 whereby a supply of fuel gas is supplied to the nozzle assembly 16. Spud 28 is connected to a coupling 42 (See FIG. 7) whereby fuel gas is supplied to the discharge nozzle 18. The assembly 16 also includes an elongated, hollow burner tube 30 and a base 32. Tube 30 extends between base 32 and discharge nozzle 18 and provides a passageway for primary combustion air and accommodates the gas supply system (not shown) which interconnects spud 28 and coupling 42.

Figure 5:
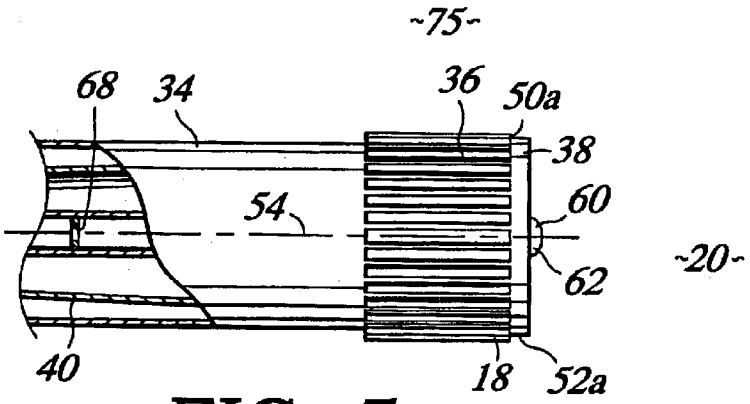
FIG. 5 is an enlarged view, partly in cross-section, of the discharge nozzle of FIG. 3.
Figure 6:
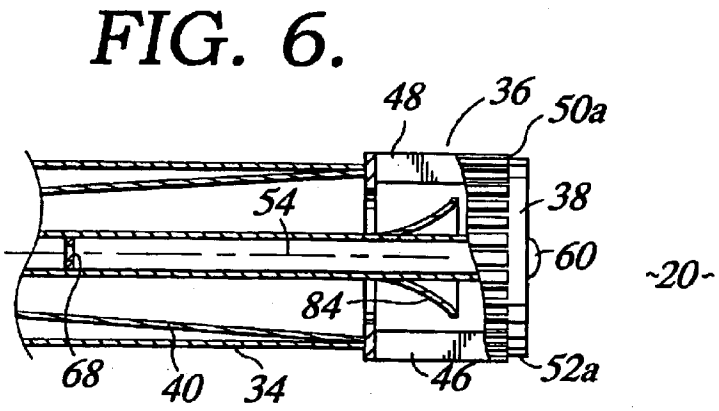
FIG. 6 is an enlarged view, similar to FIG. 5, which is partly in cross section to illustrate an embodiment of an internal baffle.
Figure 7:
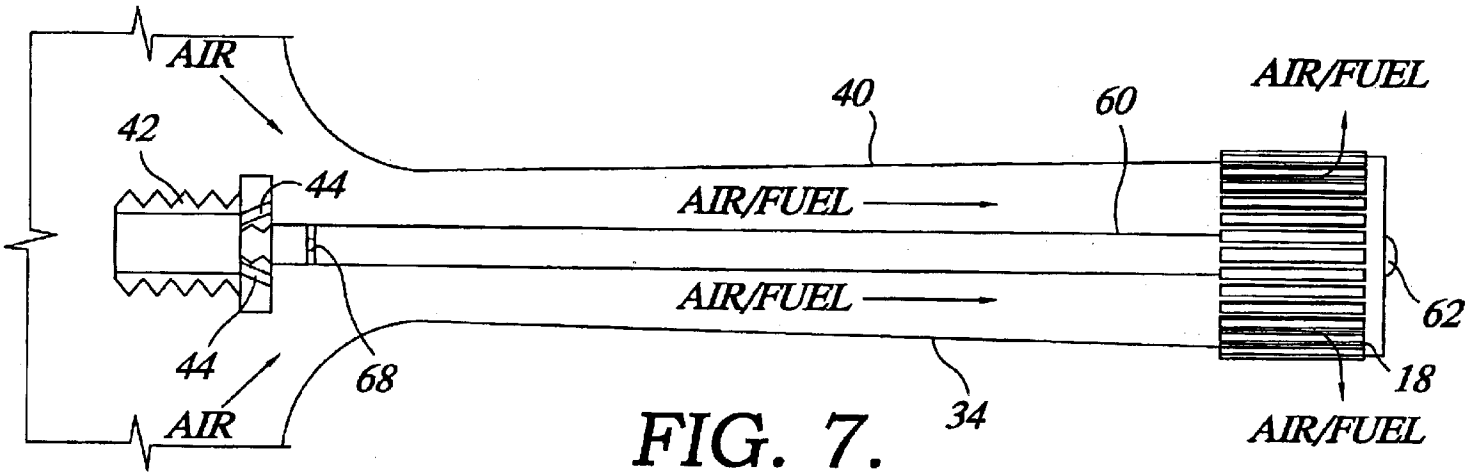
FIG. 7 is a schematic view of the nozzle arrangement of FIG. 1.

Discharge nozzle 18 preferably includes a fuel distribution section 36 and an end cap 38. With reference to FIGS. 5, 6 and 7, it can be seen that the downstream portion 34 of tube 30 may preferably include a venturi tube 40 whereby fuel gas being ejected through an opening 44 in coupling 42 induces a flow of combustion air from the interior of tube 30. Preferably coupling 42 may be provided with a plurality of openings 44 as shown. The fuel gas ejected through the openings 44 mixes with the induced air to preferably form a combustible fuel lean fuel gas/air mixture which travels through portion 34 of tube 30 toward and into fuel distribution section 36.

Figure 3:
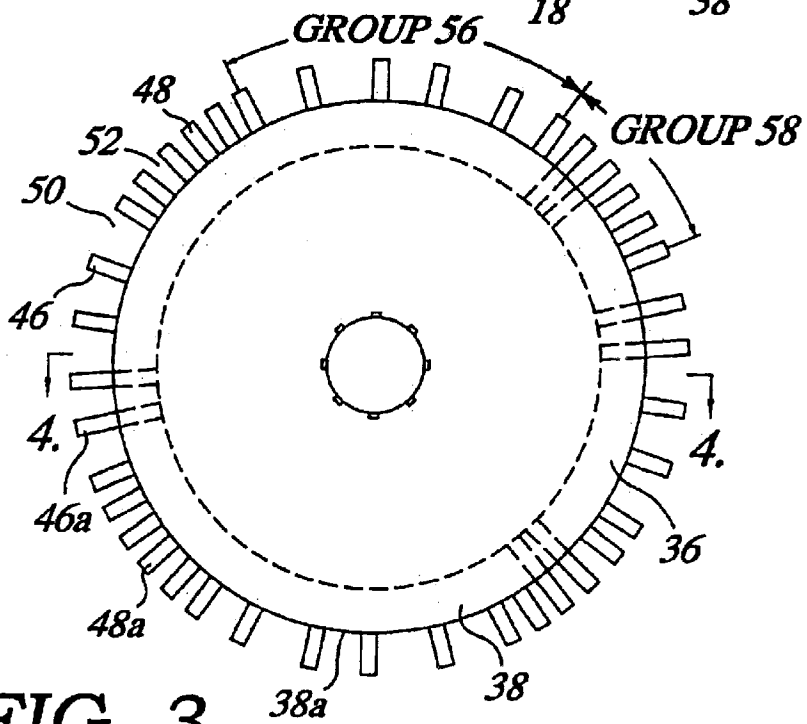
FIG. 3 is a schematic plan view of a preferred embodiment of the discharge nozzle of the nozzle arrangement of FIG. 2.
Figure 4:
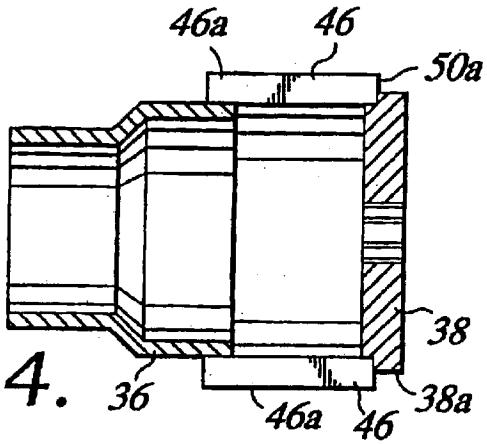
FIG. 4 is an enlarged elevational, cross-sectional view of the discharge nozzle of FIG. 3.

Fuel distribution section 36 is illustrated in FIGS. 3 and 4. Section 36 includes a plurality of fin-like flow directing members 46 and 48 which define therebetween a plurality of passageways 50 and 52 which extend in a generally radial direction relative to the central axis 54 of the nozzle assembly 16. The members 46 and 48 may be sized and arranged such that the passageways 50 defined between adjacent members 46 may be larger in cross-sectional flow area than the passageways 52 defined between adjacent members 48. In operation, the fuel/air mixture flows through portion 34 of tube 30 in a direction which is generally parallel to axis 54. As the air/fuel mixture approaches end cap 38, the air/gas mixture is redirected so that it flows radially outward through the passageways 50 and 52. It is to be noted in this regard that the respective outer extremities 46*a* and 48*a* of members 46 and 48 are preferably spaced further from axis 54 than the outer edge 38*a* of cap 38. This provides respective openings 50*a* and 52*a* (see FIG. 5) at the axially outer ends of passageways 50 and 52 which permit a portion of the air/fuel combustible mixture adjacent thereto to bend slightly and flow toward zone 20 rather than in a direction at right angles to axis 54.

Figure 8B:
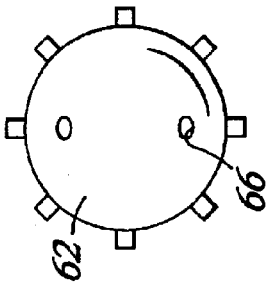
FIGS. 8A and 8B respectively are side elevational and plan views an embodiment of a central staged nozzle tip for the nozzle arrangement of FIG. 2.
Figure 8A:
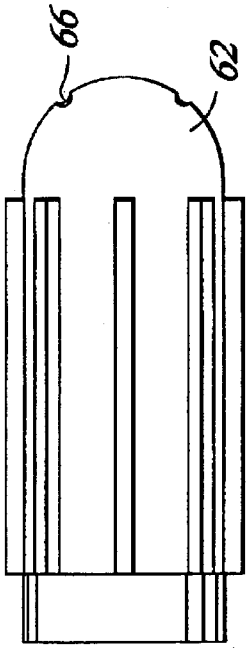
Figure 11:
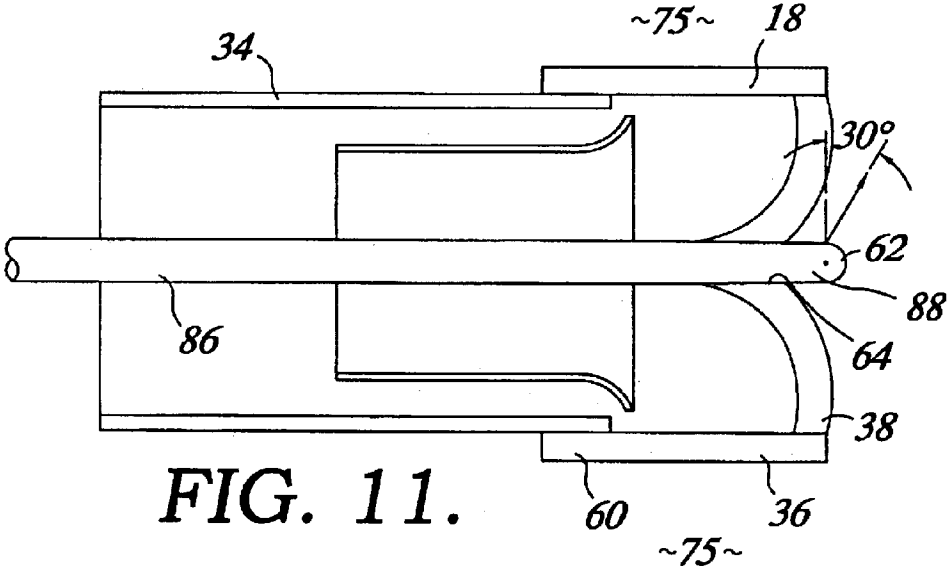
FIG. 11 is a schematic side elevational view of one embodiment of a nozzle arrangement that is useful in connection with the invention.

With particular reference to FIG. 3, it can be seen that the members 46 and 48 may be arranged so as to provide respective groups 56 and 58 of passageways 50 and 52. As shown, each group 56 includes five passageways 50 and each group 58 includes five passageways 52. As can clearly be seen from FIG. 3, the passageways 50 are wider than the passageways 52 so that the cross sectional flow areas provided by passageways 50 are greater than the cross-sectional flow areas provided by passageways 52. As shown, the groups 56 and 58 are arranged around section 36 in alternating positions. It can also be seen that in the presently preferred embodiment, the section 36 includes four groups 56 and four groups 58. However, it is to be noted that the passageways may be arranged in a variety of equally acceptable arrangements, depending upon the design and operational characteristics desired. The sizes of the passageways 52 and 50 may be varied to facilitate increased velocity, particularly through passageways 52. Increased velocity through passageways 52 relative to the velocity through passageways 50 provides increased diffusion of recirculated flue gas In one preferred embodiment of the invention, shown particularly in FIGS. 11 and 12, a central secondary staged fuel nozzle 60 protrudes through a hole 64 provided in end cap 38. Nozzle 60 includes a length of gas supply tubing 86 that extends along axis 54 and through portion 34. A staged burner tip 62 is mounted at the downstream end 88 of the tubing 86. Tip 62 may be as is illustrated in FIGS. 8A and 8B, where it can be seen that the same may be provided with delivery openings 66 for directing the flow of preferably raw fuel into zone 20 in spaced relationship relative to a radiant combustion area 75 in zone 20 adjacent face 74 (see FIG. 1). As shown in FIGS. 8A and 8B, openings 66 may be disposed at an approximate angle of 45° from the plane of the tile face; however, the angle required for any given installation may vary depending upon the desired operational and performance characteristics of the burner. In this latter regard, the angle of openings 66 should desirably not be less than about 30°, as shown schematically in FIG. 11, to insure that premature mixing of the staged fuel with an oxygen rich mixture is avoided. Likewise, the number and spacing of the openings 66 is a function of the desired performance characteristics.

Figure 12:
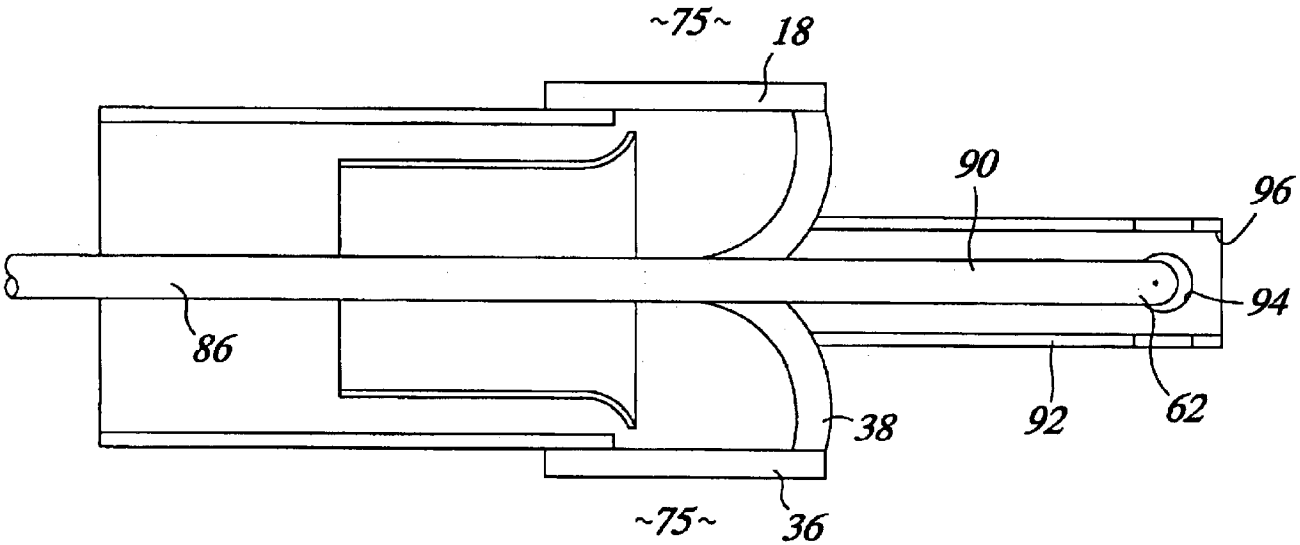
FIG. 12 is a schematic side elevational view of an alternative embodiment of a nozzle arrangement that is useful in connection with the invention.
Figure 13:
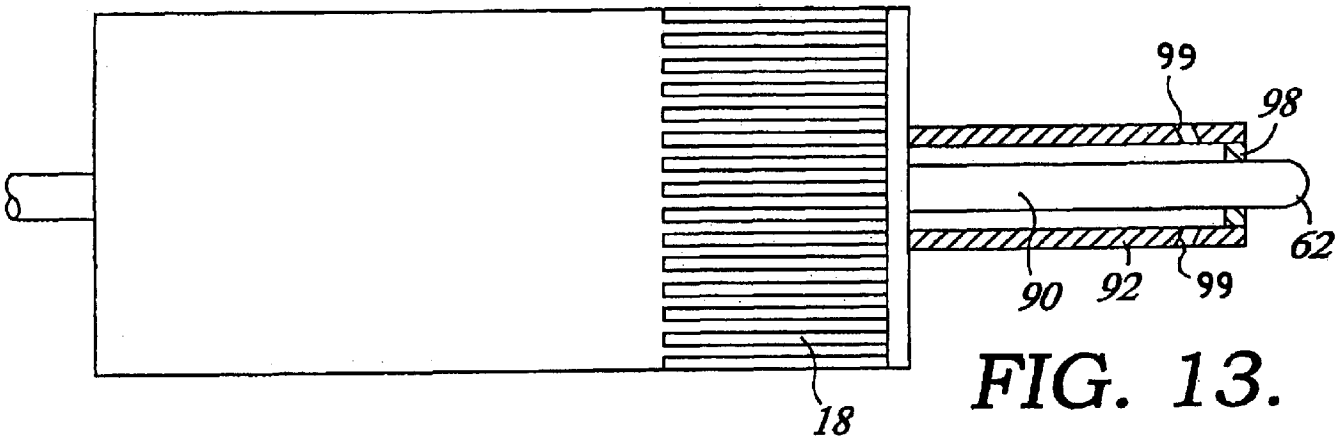
FIG. 13 is a schematic side elevational view of another alternative embodiment of a nozzle arrangement that is useful in connection with the invention.
Figure 14:
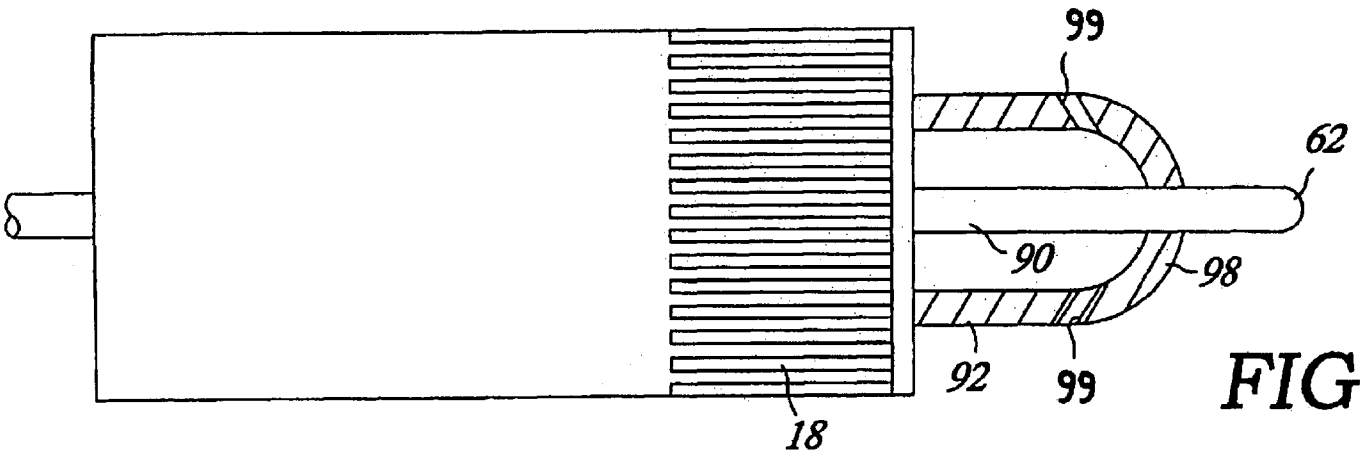
FIG. 14 is a schematic side elevational view of yet another alternative embodiment of a nozzle arrangement that is useful in connection with the invention.

In another embodiment of the invention, nozzle 60 may be as shown in FIGS. 12, 13 and 14, where the downstream portion 90 of tubing 86 protrudes beyond end cap 38 such that the tip 62 is positioned in spaced relationship relative to end cap 38. In this case, the assembly 16 may preferably include a cylindrical sheath 92 which is mounted on end cap 38 and extends along the entire length of protruding portion 90 in surrounding relationship to the latter. Appropriately positioned openings 94 may be provided in sheath 92 to permit the entirety of tip 62 to be protected from the heat of the combustion zone and yet allow egress of staged fuel from tip 62.

As shown in FIG. 12, the sheath 92 may also have an open end 96 which is adapted to vent the sheath 92 by permitting gases between the sheath 92 and the tubing 86 to escape into the combustion zone. Alternatively, the arrangement may be as shown in FIGS. 13 and 14, where the end of the sheath 92 is closed by a flat (FIG. 13) or domed (FIG. 14) cap 98. In this case, appropriate vent holes 99 may be provided in the wall of the sheath 92. These vent holes 99 serve essentially the same purpose as the open end 96, but as shown, the same may preferably be disposed at a downwardly inclined angle of about 10° relative to a plane which is perpendicular to the longitudinal axis of the sheath 92. Desirably, nozzle 60 may also be provided with an orifice 68 as shown in FIG. 5 to control the amount of fuel which flows into the combustion zone via nozzle 60.

In accordance with the concepts and principles of the invention, the tip 62 desirably may be positioned far enough away from the premixed discharge nozzle 18 such that the flow patterns of the oxygen rich and radially moving combusting gases in the radiant combustion area 75 and the staged fuel injected via nozzle 60 are mechanically decoupled so as to avoid burning of the staged fuel in an oxygen rich environment. Thus, the staged gas jet leaving tip 62 is far enough from the premixed flow envelope such that the momentum of the jet is insufficient to cause the staged gas and the premixed gas/air mixture to intermingle, at least until the fuel from nozzle 60 has had an opportunity to become mixed with flue gas. This is extremely important, particularly when considered in conjunction with the ultralean concept of the primary air/fuel mixture where the large amount of excess air left over from the combustion in the radiant heating area 75 is significant enough to cause localized combustion to start at the tip of the staged riser, thus increasing $NO_x$ emissions. Desirably, for best results in $NO_x$ abatement, the staged fuel should be combusted in an atmosphere which contains no more than about 4% oxygen by volume.

Figure 9:
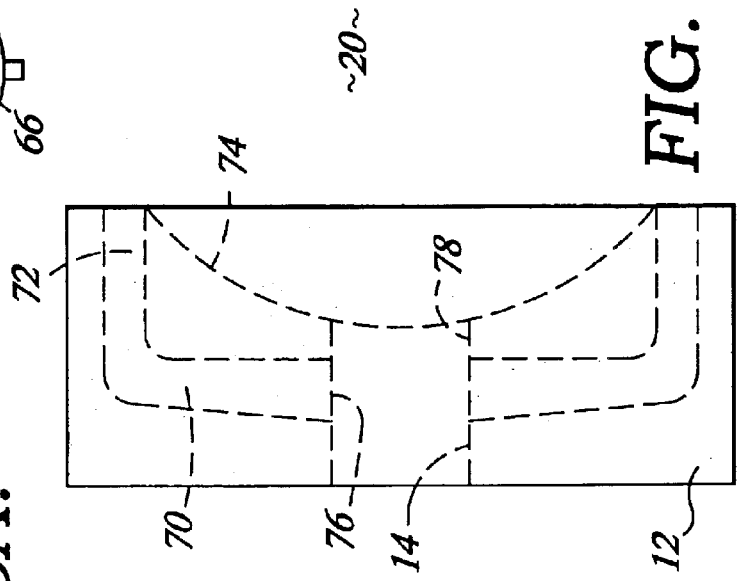
FIG. 9 is a side elevational view of an embodiment of a tile for use with the burner of FIG. 1.
Figure 10:
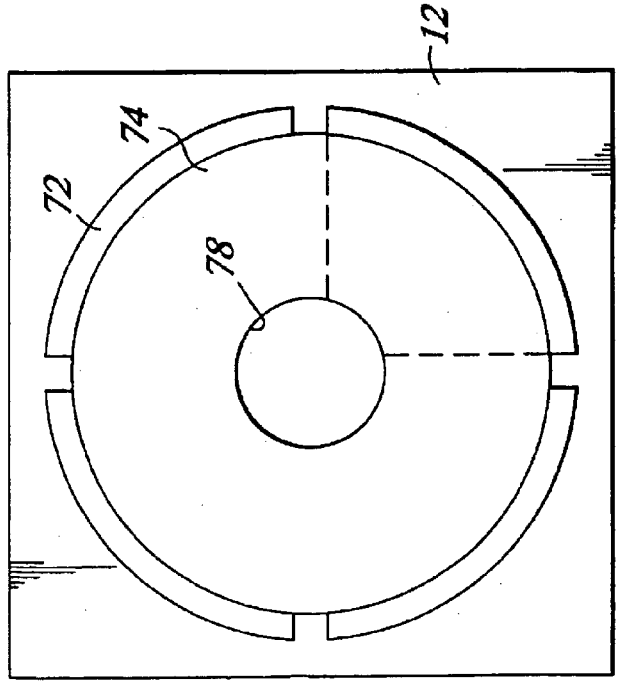
FIG. 10 is a plan view of the tile of FIG. 9.

With reference to FIGS. 9 and 10, for some important applications utilizing the concepts and principles of the invention, the opening 14 may desirably be larger in internal diameter than the outer diameter of tube portion 34 so that secondary combustion air may flow into zone 20 through the annular space between opening 14 and cylindrical section 34. In accordance with the invention this aspect of the invention, and as illustrated in FIGS. 9 and 10, secondary air ducts 70 may be provided to facilitate and improve the flow of secondary air. One end 72 of duct 70 is in communication with zone 20 at the face 74 of tile 12. The other end 76 of duct 70 is in communication with opening 14. As can be seen from FIG. 10, end 72 is arcuate in shape so that the same projects a fan-shaped flow of air into zone 20. End 76 is also arcuate in shape and in general is in the shape of a slot which extends around the internal surface 78 of opening 14. In accordance with the invention, the face 74 of tile 12 may be dished or flat. Dishing may facilitate recirculation of flue gas inside the dish.

In the operation of a burner which incorporates the tile illustrated in FIGS. 9 and 10, the fuel lean fuel/air mixture leaving passageways 50 and 52 travels radially, outwardly of axis 54 and generally across face 74 of tile 12 where it is burned in a radiant combustion area 75 adjacent face 74. The combustion products of the fuel/air mixture eventually intermix with raw fuel from nozzle 60. In many embodiments of the invention, the intermixture may be fuel rich, and after combustion, the same may provide a generally laterally extending flame having an outer peripheral extremity at the radial periphery of area 75, which periphery is spaced radially from the axis. Preferably, end 72 of duct 70 may be positioned so as to provide a fan of air to the flame at the outer peripheral extremity of the laterally extending flame.

An embodiment of the nozzle of the invention which includes an internal baffle 84 is shown in FIG. 6. Baffle 84 is generally in the shape of an inverted cone and the same is positioned for redirecting the flow of the air/fuel mixture traversing tube 40. The combustible mixture travels along tube 40 in a generally axial direction until it encounters baffle 84 which redirects the flow so that it moves in a generally radial direction. In FIG. 6 the baffle is shown in combination with a nozzle structure which includes a centrally located raw fuel nozzle 60. However, it will be recognized by one of ordinary skill that the internal baffle will be highly useful regardless of the presence or absence of the central nozzle.

EXAMPLE

A burner embodying the concepts and principles of the invention was operated as follows: the burner is fired at 0.63 MMBtuh; excess air is 10%; furnace temperature is 1800° F.; burner differential pressure is 0.25 inches of water; secondary and primary burner damper is fully opened; combustible gas is 50% natural gas and 50% hydrogen; burner is aligned with outer cupped tile edge and then pushed in 0.25 inch.

Measured results using a single burner: 2.5% $O_2$; 0 ppm CO; and 8 to 10 ppm $NO_x$.

Measured results using an array of 13 burners: 2.5% $O_2$; 0 ppm CO; and 15 to 19 ppm $NO_x$.

As a result of the experiment it was noted that with deeper staging of air through the tile, $NO_x$ emissions can be brought down by a significant percentage of the overall emissions.

The advantages provided by the invention described above include very low $NO_x$, low noise, partial premix with a rich gas stream axially staged for low $NO_x$, prompt $NO_x$ alleviation with fuel induced furnace gas recirculation, simplicity, short flame profile, high pressure utilization at turndown for jet stability, high stability, operation with either flat or cupped tile face, facilitation of the manipulation of L/D for defined combustion of premixed fuel and air, staged air tile further decreases $NO_x$ formations with staged air technology, staged gas is directed away from furnace wall for slowed combustion, and secondary air staging is integral part of tile such that no excess air is needed at the base of the premix tip.

The burner of the invention is of a premix design. The burner may also include a venturi that is preferably optimized sufficiently to deliver an extremely fuel lean premix of air and fuel to the main discharge nozzle of the burner. The discharge nozzle may be designed so that its slots have a significant L/D (width to depth ratio) to keep each individual premixed jet as a defined individual flame envelope. This allows for the natural recirculation patterns of the tile and furnace to inject furnace flue gas into each stream. This is one factor in the reduction of $NO_x$.

The discharge nozzle may be arranged in eight sections, four (4) that are high flow and four (4) that are of lower flow. Since the webbing between each section is proportional the recirculation of flue gases in the tighter restricted area is more pronounced. The variation of area assures stability in the larger flow areas while the smaller areas are subjected to a higher percentage of flue gas by diffusion due to the smaller mass.

As described above, a center riser 60 may be inserted through the burner tube 34, which preferably may be a venturi, so that the riser protrudes through the end plate 38 of the discharge nozzle 36. The center riser 60, which provides a secondary or staged nozzle, is fed pure gas fuel (unpremixed) at a pressure of about 10 psig. The gas is then expelled via a staged tip 62 designed to handle the high temperatures of the furnace and subsequently burned. This tip 62 desirably provides a L/D sufficient to ensure that the gas can be directed at an angle as required to oxidize the gas in a stable manner away from the heat of the furnace wall. This ensures that the combustion process is impeded, but not enough to induce appreciable amounts of CO.

The tip pressure is maintained by an integral orifice 68 located in the line from the main gas spud to the staged tip. The discharge nozzle 36 and the staged tip 62 interact together in flow patterns created by the open slots in the face of the discharge nozzle 36 to insure appropriate staging of the raw fuel and the subsequent recirculation of the CO and $CO_2$ formed to lower the $NO_x$ further in the primary premixed section of the flame.

Another aspect of the burner of the invention is its capability to utilize a truly staged air tile formation, whereby secondary air is mixed into the premixed portion of the flame at its peripheral tip. The $NO_x$ can be further impeded by the mixing mechanics of this secondary air tile as it stages the air out instead of allowing the secondary air to come into contact with the base of the premixed flame envelope.

Figure 15:
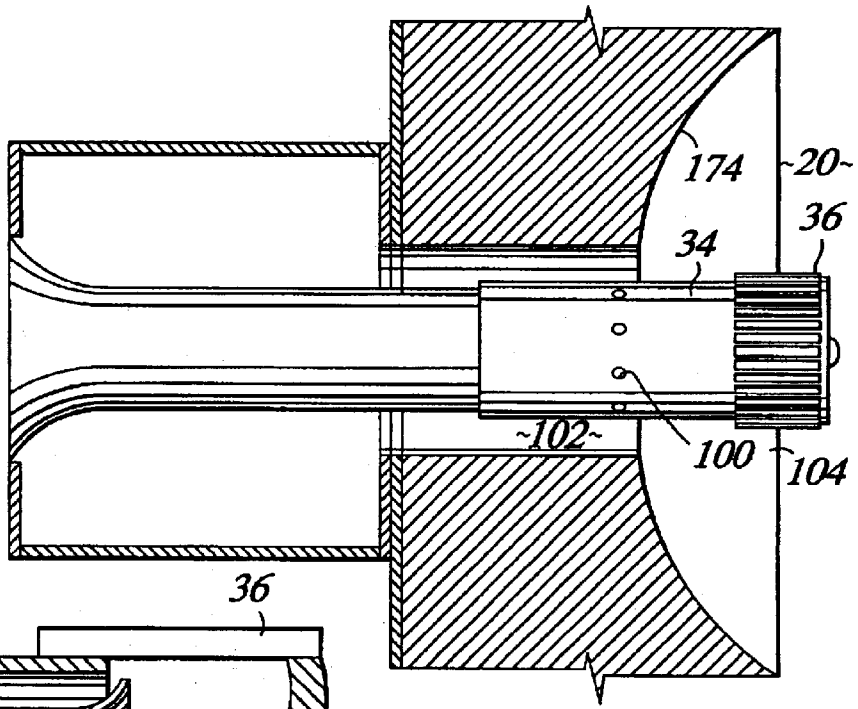
FIG. 15 is a side elevational view of yet another burner arrangement which embodies the concepts and principles of the invention.
Figure 16:
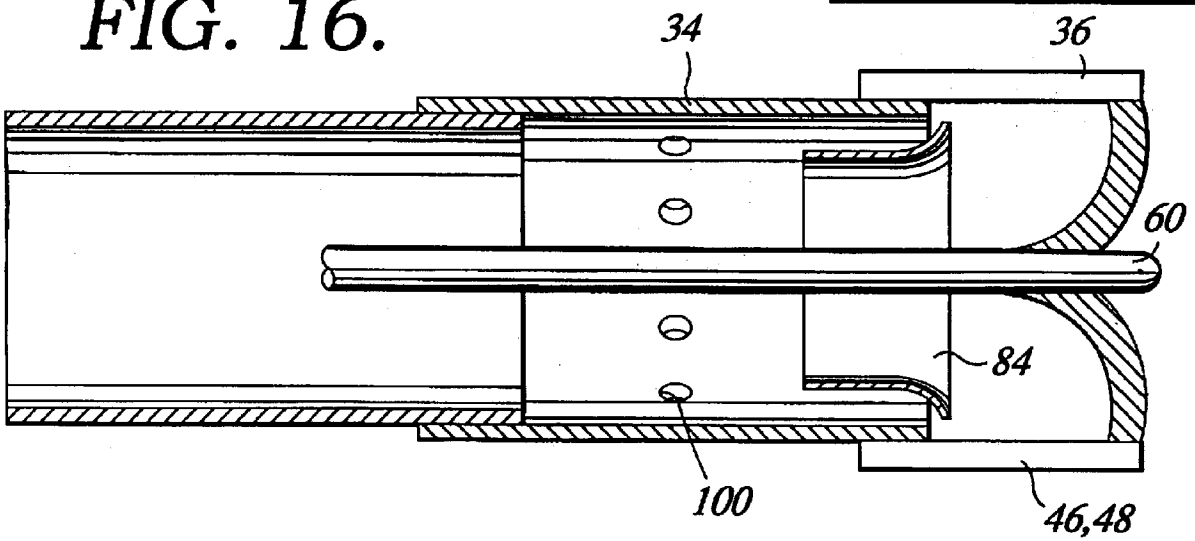
FIG. 16 is an enlarged cross sectional view of the discharge nozzle of the burner of FIG. 15.
Figure 17:
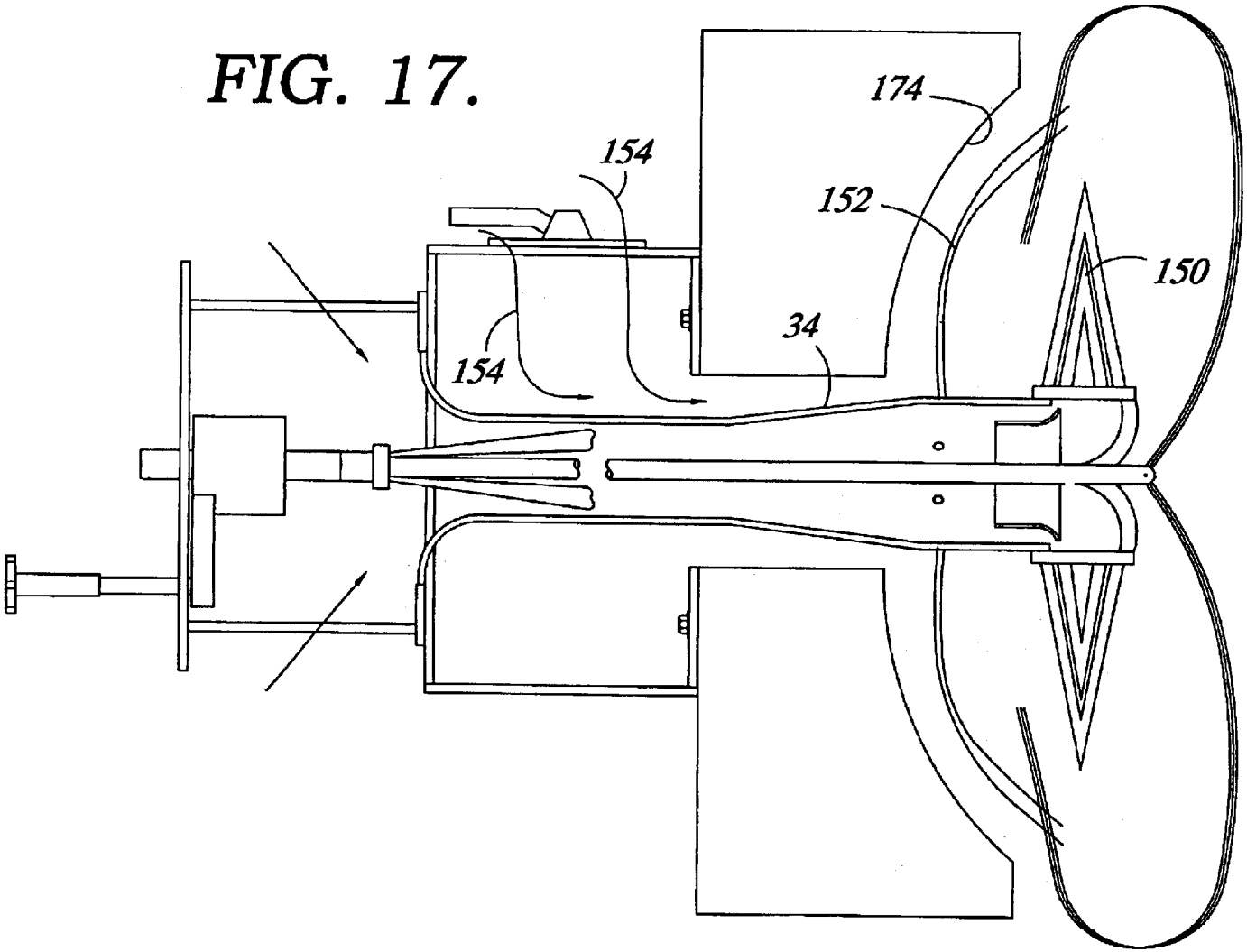
FIG. 17 is a schematic view illustrating the operation of the burner of FIG. 15, including a schematic showing of the flow paths of the several combustion and flameless oxidation streams.

In another preferred embodiment of the present invention, and as illustrated in FIGS. 15, 16 and 17, the burner may be provided with one or more, preferably several, and ideally eight or more radially extending ports 100 in the wall of the centrally disposed tube 34 which provides a conduit for delivering the central air/fuel mixture to the burner tip. These ports 100 communicate with the space 102 surrounding the tube 34 whereby a portion of the air/fuel mixture flows through the ports 100 and becomes admixed with secondary air flowing along the outside of the tube 34 toward the combustion zone 20. The admixture thus formed may generally be too lean to support a conventional flame; however, low temperature oxidation thereof occurs at face 174 of the burner tile 104, whereby $NO_x$ emissions are minimized.

In accordance with a particularly preferred form of the invention described above, where the ports 100 are used in connection with a radiant burner having a cupped tile 104, the ports 100 provide for a prestaging of some of the premixed air and fuel resulting in decreased tip velocity through discharge nozzle 36, enhanced stability and minimization of $NO_x$ emissions. The cupped tile 104 enables the placement of the ports 100 at a location about 3 full inches upstream from the discharge nozzle 36 whereby, as shown in FIG. 17, the already lean air/fuel mixture 152 escaping from the central tube 34 through the ports 100 is able to become thoroughly admixed with secondary air flowing in the direction of the arrows 154 along the outside of tube 34 to present an ultra lean admixture well before the latter reaches the face 174 of the tile. This ultra lean admixture undergoes low temperature oxidation without conventional flame on the face of the tile. The products of this low temperature oxidation are then entrained into the main flame 150 created at the discharge nozzle 36 and provide a quenching, cooling effect to thereby reduce $NO_x$ in the main flame. The overall effect provides in a reduction of $NO_x$ emissions to a level well below 10 parts per million on a volumetric basis (ppmv). In accordance with the principles and concepts of the present invention, $NO_x$ emissions below 5 ppmv can be achieved consistently.

The attributes of this form of the invention include: 1) low $NO_x$ emissions with staged fuel; 2) flameless combustion coupled with rapid oxidation in the proximity of the tile; 3) low noise as a function of tip pressure and heat release; 4) staged gas jets entraining flue gas external to the burner; 5) prompt $NO_x$ alleviation; 6) secondary air has less effect on $NO_x$ emissions; 7) short flame profile; 8) high turndown ratios with added premix tip velocities; 9) high stability; 10) minimization of CO emissions; 11) very lean premixed zone; 12) oxidation against radiant tile with stoichiometry below LEL's (cold combustion); and 13) three separate fluid flow zones containing different stoichiometries of gas and air.

As shown in FIG. 16, the holes 100 for directing a portion of the primary air/fuel mixture into the flow of secondary air on the outside of the burner tube 34 to thus create an ultra lean mixture of air and fuel, desirably may be used in conjunction with a burner nozzle which includes flow directors such as the directors 46, 48, a central nozzle such as the nozzle 60, and an internal baffle such as the baffle 84.

Broadly, in accordance with the concepts and principles of the configuration illustrated in FIGS. 15, 16 and 17, by prestaging a volume of an ultra lean premixed air and fuel gas in conjunction with a premixed burner and a fuel rich staged tip, ultra low $NO_x$ emissions may be achieved in conjunction with a tile designed to facilitate flameless combustion of the prestaged ultra lean admixture while maintaining separation of the latter from the main flame until a appropriate product mix is achieved to dilute and cool the main flame so as to lower emissions therein.

In the burner of FIGS. 15, 16 and 17, once some fraction of the fuel, ranging from about 15% of the fuel to all of the fuel, is mixed with air, a small portion of the mixture is removed prior to the main discharge nozzle and redirected into a secondary air stream. In the case of a radiant wall burner, the premix is removed from the central tube 34, which may be in the form of a venturi, by means of ports (radially drilled holes) 100 positioned around the body of the burner prior to the tip. In another configuration the premix may be mixed with recirculated flue gas that is ported back through the tile using special ports. This creates a mixture that is below the flammability limits and incapable of sustaining combustion. This stream must then pass through the highly radiant tile section that is capable of accelerating the kinetics of the gas and causing a rapid oxidation of the fuel even though it is below its flammability limits. When substantial oxidation, if not complete oxidation, has taken place this stream is then remixed with the main premixed air and gas stream that is exiting the main burner tip and is just within its flammability limits. The main premix stream sustains and stabilizes the combustion. The oxidized stream has a quenching effect on the main flame, lowering its theoretical temperature by putting a heat load on the flame by means of extra mass.

In addition, a secondary staging of pure fuel gas is also being introduced from a secondary tip 60 downstream of the main burner premix discharge nozzle. The secondary fuel is introduced further into the furnace and uses the kinetic energy of its sonic jets to entrain and mix in substantial amounts of furnace flue gas before it is pulled back into the main flame by the momentum of the main flame and the force of recirculating furnace gases. This also has a quenching effect to the main flame and also serves to bring the flammability limits of the overall mixture into a range that is once again flammable. The stabilizing affect of the refractory helps to maintain a stable flame envelope during turndown and low oxygen regimes seen during operational excursions within the furnace.

It is important to note that the premix prestaging technique described in connection with FIGS. 15, 16 and 17 provides $NO_x$ reductions to approximately half of what was already an ultra-low $NO_x$ burner. It should be noted in this regard that the premix prestage concept facilitated by the holes 100 can be extended for use with essentially any burner shape and/or mounting pattern. In other words, the premix prestaging technique can be extended to essentially any burner application. Thus, this concept may be used to make very low $NO_x$ round flame, upfired or sidefired burners, as well as rectangular flat flame burners and downfired burners. The concept may also be utilized in both, what are fundamentally diffusion flame burners as well as full fledged premixed type burners.

The use of a lean primary air/fuel mixture augmented by a flameless combustion zone within the tile located in proximity to the main flame, plus a substantial staged portion of the gas in fuel rich form that is subsequently returned to the main flame by entrainment and momentum via a nozzle such as the nozzle 60 to provide reduction of theoretical temperature by additional mass, is a very important feature of the invention.

Overall, the invention is adaptable so as to provide several families of burners ranging from radiant wall burners to horizontal, upfired, and even downfired burner designs with the capability of delivering $NO_x$ emissions much below current burner technologies.

In another configuration, in accordance with the concepts and principles of the invention, the ported nozzle arrangement may be used in conjunction with a specially ported version of a tile that is adapted to recirculate flue gas which may then be used instead of secondary air to dilute the ported primary air/fuel mixture. Such an arrangement also may be used to provide and maintain a lean premix behind the tile assuring that combustion which would be detrimental to the burner tip does not take place. The spin off to this is the loading of the flame that helps to lower the theoretical temperature of the flame much more than is typically seen in burner designs. The flameless combustion zone may be controlled and kept separate from the main flame until most of the initial oxidation is complete.

The concepts and principles of the present invention add a new twist to an already evolving technology. The creation of a flameless combustion zone (lean premixed) coupled with specific tile designs to control and stabilize the combustion process operate together to provide low $NO_x$ without the use of flue gas recirculation and/or other dilution methods for reducing flame temperature.

The burner of FIGS. 15, 16 and 17 provides single digit $NO_x$ numbers in what may be considered "within the parts that are usually included in a conventional burner". By adding the flameless combustion zone behind the main flame, new ground has been broken in addressing what is considered the "prompt NOregime" of $NO_x$ production.

The joining of all of these various aspects of the invention allows the burner of the invention to deliver $NO_x$ emissions in the range of single digits to the mid teens (ppm) depending on the number of burners in the array, and the species and concentrations of the species in the fuel mix. Thus, in accordance with the invention, it has been discovered that it is possible to combine many known theories of $NO_x$ abatement into a single burner that provides stable operation and appropriate turndown while performing in a range that has not previously been thought possible. In accordance with the invention, shorter flame patterns are possible especially when the fuel comprises heavy hydrocarbons; larger turn down ratios are possible on high hydrogen fuels, particularly when an internal baffle is utilized; much lower noise is experienced around a burner with multiple ports and small jets; either cupped or flat tiles may be utilized interchangeably; staged air tile design allows for $NO_x$ adjustment while running; burner adjustment capabilities in the tile allow for $NO_x$ adjustment; tips are easily removed and serviced by design; and the direction of the staged jets at turndown help to stabilize the primary flame.

I claim:

1. A low $NO_x$ burner nozzle assembly comprising:

an elongated hollow burner tube providing a longitudinally extending conduit for supplying a mixture of fuel and air to a combustion zone, said burner tube having an outer wall surrounding said conduit, a longitudinally extending central axis, an inlet end and an outlet end;

a discharge nozzle located at the outlet end of the burner tube, said discharge nozzle being in direct communication with said conduit and configured and arranged for receiving at least a portion of said mixture of fuel and air from the conduit and directing the same into said combustion zone;

an inlet for a mixture of fuel and air at the inlet end of the burner tube;

an air passageway located outside the outer wall of the burner tube for supplying air to said combustion zone; and at least one port extending through said outer wall at a location between the discharge nozzle and said inlet end of the conduit, said port communicating with the air passageway, whereby to facilitate the passage of a portion of said mixture of fuel and air from the conduit and into said air passageway for admixture with air flowing through the air passageway.

2. A nozzle assembly as set forth in claim 1, wherein said air passageway is annular and surrounds said outer wall.

3. A nozzle assembly as set forth in claim 2, wherein said port has a center axis which is essentially perpendicular to said central axis.

4. A nozzle assembly as set forth in claim 2, wherein said port has a center axis which is at an angle relative to said central axis.

5. A nozzle assembly as set forth in claim 2, comprising a plurality of said ports extending through said wall at respective locations between the discharge nozzle and said inlet.

6. A nozzle assembly as set forth in claim 5, wherein said ports are arranged in one or more rows which extend around said outer wall.

7. A nozzle assembly as set forth in claim 5, wherein each of said ports has a center axis which is essentially perpendicular to said central axis.

8. A nozzle assembly as set forth in claim 7, wherein said center axes are arranged in a common plane which is essentially perpendicular to said central axis.

9. A nozzle assembly as set forth in claim 1, wherein said location is closer to said discharge nozzle than it is to said inlet end.

10. A nozzle assembly as set forth in claim 8, wherein said common plane is positioned closer to said discharge nozzle than to said inlet end.

11. A nozzle assembly as set forth in claim 1, wherein said discharge nozzle includes a plurality of flow directing members which are arranged to define therebetween a plurality of passageways which extend in generally radial directions relative to said axis, and an end cap mounted on said members in a location to redirect at least a portion of the mixture flowing from the end of the conduit and cause the same to flow through said passageways in a generally radial direction.

12. A nozzle assembly as set forth in claim 11, wherein said members are arranged so that some of said passageways have a larger flow area than others of said passageways.

13. A nozzle assembly as set forth in claim 11, wherein said air passageway is annular and surrounds said outer wall.

14. A nozzle assembly as set forth in claim 13, comprising a plurality of said ports extending through said outer wall, and wherein said ports are arranged in one or more rows which extend around said outer wall.

15. A low $NO_x$ radiant wall burner comprising a burner tile having a central opening and a nozzle assembly as set forth in claim 1, the burner tube of said nozzle assembly being adapted and arranged so as to extend through said central opening.

16. A burner as set forth in claim 15, wherein the discharge nozzle of said nozzle assembly includes a plurality of flow directing members which are arranged to define therebetween a plurality of passageways which extend in generally radial directions relative to said axis, and an end cap mounted on said members in a location to redirect at least a portion of the mixture flowing from the end of the conduit and cause the same to flow through said passageways in a generally radial direction.

17. A burner as set forth in claim 16, wherein said members are arranged so that some of said passageways have a larger flow area than others of said passageways.

18. A burner as set forth in claim 16, wherein said air passageway is annular and surrounds said outer wall.

19. A burner as set forth in claim 18, comprising a plurality of said ports extending through said wall, and wherein said ports are arranged in one or more rows which extend around said outer wall.

20. A burner as set forth in claim 16, wherein the passageways are arranged such that the redirected mixture of fuel and air, when ignited, provides a generally laterally extending flame having an outer peripheral extremity at a location in said zone spaced radially from said axis.

21. A method for operating a burner comprising:

providing a mixture of fuel and air and causing the same to flow toward a centrally located point adjacent a face of a burner tile;

providing a secondary stream of at least one of additional air and recirculated flue gas;

diverting a first portion of said mixture and intermixing the same with said secondary stream to thereby create a fuel lean admixture, the relative proportions of said mixture and said secondary stream in said admixture being such that the latter is capable of flameless oxidation;

causing the remaining portion of said mixture to combust and flow radially outwardly from said point across the face of said tile while combusting;

causing said fuel lean admixture to flow toward a location adjacent the face of the tile and spaced laterally from said point, and oxidizing the fuel lean admixture flamelessly to thereby create relatively cool oxidation products before the same reaches said location.

22. A method for operating a burner as set forth in claim 21, said method further comprising dividing said remaining portion of said mixture into a plurality of separate streams, and causing said separate streams to flow radially outwardly from said point across the face of said tile to form a flame which surrounds said point.

23. A method as set forth in claim 21, comprising admixing said oxidation products with said combusting remaining portion of said mixture to thereby dilute and cool the latter.

24. A method as set forth in claim 21, wherein said secondary stream comprises additional air.

25. A method as set forth in claim 21, wherein said secondary stream comprises recirculated flue gas.

26. A method as set forth in claim 21, wherein said secondary stream comprises recirculated flue gas and additional air.

* * * * *

UNITED STATES PATENT AND TRADEMARK OFFICE

CERTIFICATE OF CORRECTION

PATENT NO. : 6,905,328 B2
DATED : June 14, 2005
INVENTOR(S) : Roger L. Poe

It is certified that error appears in the above-identified patent and that said Letters Patent is hereby corrected as shown below:

Column 4,
Line 67, delete "Blame-" and insert -- flame- -- therefor.

Signed and Sealed this

First Day of November, 2005

JON W. DUDAS
*Director of the United States Patent and Trademark Office*